United States Patent [19]

Brosch

[11] Patent Number: 4,800,656

[45] Date of Patent: Jan. 31, 1989

[54] DEVICE AND PROCESS FOR DRYING SOLVENT-CONTAINING PLASTIC SHEETS OR FILMS

[75] Inventor: Oswald Brosch, Eimeldingen, Fed. Rep. of Germany

[73] Assignee: Lonza-Werke GmbH, Waldshut, Fed. Rep. of Germany

[21] Appl. No.: 5,841

[22] Filed: Jan. 21, 1987

[30] Foreign Application Priority Data

Jan. 28, 1986 [CH] Switzerland ..... 00316/86

[51] Int. Cl.[4] ..... F26B 9/00; F26B 25/00

[52] U.S. Cl. ..... 34/159; 34/242

[58] Field of Search ..... 34/155, 159, 161, 242; 26/101, 102, 103, 104

[56] References Cited

U.S. PATENT DOCUMENTS

| | | | |
|---|---|---|---|
| 398,647 | 2/1889 | Odenheimer | 34/161 |
| 2,220,522 | 11/1940 | Ives | 34/159 |
| 3,222,714 | 12/1965 | Sakakibara et al. | 34/161 |
| 3,543,365 | 12/1970 | Helminen | 26/104 |
| 3,891,223 | 6/1975 | Sonnen | 34/242 |
| 4,231,167 | 11/1980 | Duris | 34/159 |
| 4,253,246 | 3/1981 | Marchal | 34/159 |

FOREIGN PATENT DOCUMENTS

| | | |
|---|---|---|
| 2049817 | 4/1971 | Fed. Rep. of Germany . |
| 2048762 | 4/1972 | Fed. Rep. of Germany . |

*Primary Examiner*—Henry A. Bennet

*Attorney, Agent, or Firm*—Fisher, Christen & Sabol

[57] ABSTRACT

Drying installation for drying plastic sheets containing solvents or moisture which was made according to the casting process.

6 Claims, 1 Drawing Sheet

FIG. 1
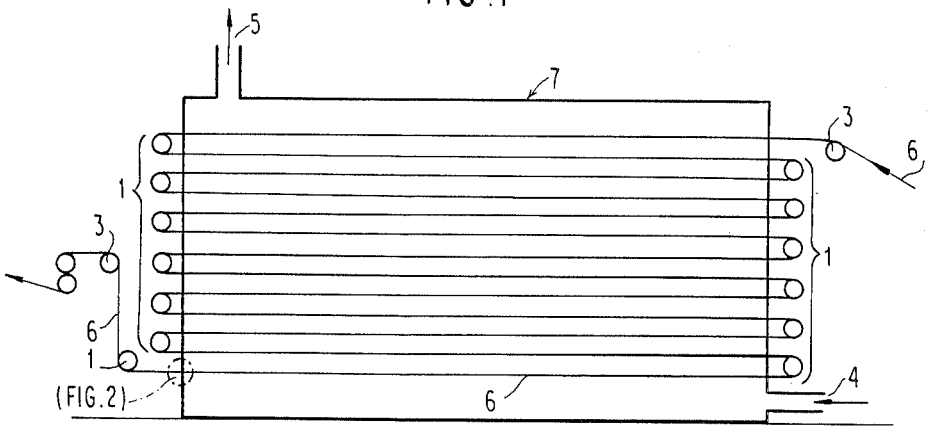
FIG. 2
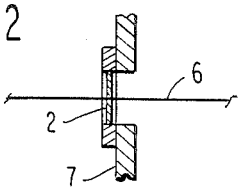
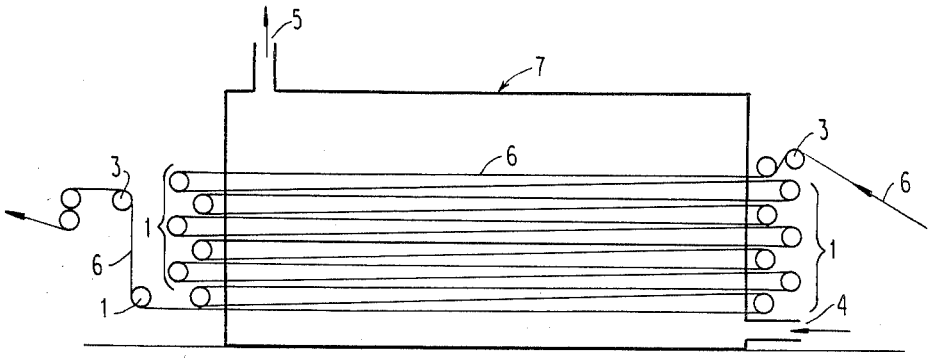
FIG. 3

DEVICE AND PROCESS FOR DRYING SOLVENT-CONTAINING PLASTIC SHEETS OR FILMS

BACKGROUND OF THE INVENTION

The invention relates to a device and a process for drying solvent-containing plastic sheets or films.

Such solvent-containing plastic sheets or films result from the use of solvents particularly in the casting process. In such case, the dry casting process is the standard process for the production of sheets or films of cellulose acetate, polyamide, ethylcellulose, polyimide, polycarbonate, PVC, polyvinyl alcohol and other materials.

Low-boiling solvents are predominantly used to achieve a sheet formation by evaporation of the solvent in as short a time as possible with the dry casting process. The sheets are produced on casting machines. From the casting vessel the solution is brought to a metal conveyor through the nozzle of the caster. The predried film is removed by the conveyor and passes through a drying oven by a path as long as possible with correspondingly numerous freewheeling undriven carrier rollrs. The remaining solvent is then removed. The sheet is pulled through the drying oven by a driven roller and then wound into a roll by a winding machine.

To avoid the formation of folds, especially in the case of thin sheets, the carrier rollers are arranged so that the sheets are carried over numerous rollers with short, free paths and deflected. These freewheeling carrier or reversing rollers are placed inside of the drying oven. Problems occur in the drying of thin sheets. The longitudinal tension increasing from roller to roller as a result of bearing friction results in a transverse contraction with formation of undulations between the rollers. This results in folds running in the feed direction, which are impressed on the rollers.

In a drying oven, the sheet passes zones conditioned by design and process and, thus, rollers of different temperatures. Rollers at higher temperatures, in comparison with the sheet, suddenly heat the sheet. Thereby, bucklings in the crosswise direction result due to heat expansion; this also results in the so-called heat folds being longitudinally oriented. Soiled or damaged rollers cause deformations of the sheet and must be laborously dismantled, cleaned or exchanged. The resultant interruption of production is an inherent disadvantage. Impairment of the bearing lubrication of the rollers by action of heat and steam in the course of time results in scratches in the sheet because of difficulty-moved or locked rollers.

BROAD DESCRIPTION OF THE INVENTION

An object of the invention is to provide a device and a process which avoid the above-described problems. Other objects and advantages of the invention are set out herein or are obvious herefrom to one skilled in the art.

The objects and advantages are achieved by the device and the process of the invention.

The invention includes a device for the drying of plastic sheets or films containing solvents and/or moisture. The device includes a drying oven housing with, in each case, several stretcher-rollers placed parallel-like on the outside of two sides of the drying oven housing opposite one another. In each case, a sealable slot is allocated to these stretcher-rollers in the side wall for the feeding and removal of the sheet. Openings are provided for the introduction and removal of the heated dryer gas. Preferably the stretcher-rollers, in parallel relationship, are staggered in relation to the wall of the dryer.

The invention also includes a process for the drying of solvent-containing plastic sheets or films. The sheets to be dried are deflected by the stretcher-rollers placed outside of the drying oven and are pulled through the drying oven free of contact.

BRIEF DESCRIPTION OF THE INVENTION

In the drawing:

FIG. 1 is a cross-sectional side view of one embodiment of the device of the invention;

FIG. 2 is a cross-sectional side view of one of the sealable slots used in the device of FIG. 1; and FIG. 3 is a cross-sectional side view of another embodiment of the device of the invention.

DETAILED DESCRIPTION OF THE INVENTION

The device of the invention is explained in greater detail by FIGS. 1 to 3.

Examples of usable stretcher-rollers are those described in German Published Patent Application Nos. 2,049,817 and 2,048,762. Preferably those according to German Published Patent Application No. 2,049,817 are used.

The following advantages are obtained by the invention:

- Traction folds are avoided since the sheet is stretched fold-free by the stretcher-rollers.
- No heat folds occur since the stretcher-rollers placed outside of the drying oven are colder than the sheet.
- Because of the design and mode of operation of the expanders, there is practically no deformation by particle deposits. Any necessary cleaning of the easily-accessible stretcher-rollers does not present a problem. Changing of rollers and the related danger of injury are eliminated.
- Scratches on the sheet because of locked rollers are eliminated since support of the stretcher-rollers takes place outside the drying oven at normal temperatures and in steam-free surroundings.

The device of the invention is explained in greater detail by FIGS. 1 to 3.

FIG. 1 shows the arrangement of drying device 7 for sheet 6. Device 7 has stretcher-rollers 1, placed one above the other in a plane, deflecting rollers 3, sealable slots 2 allocated to stretcher-rollers 1, as well as openings 4 and 5 for the feeding and removal of the dryer gas. FIG. 2 shows a sealable slot 2 in more detail.

In FIG. 3 stretcher-rollers 1, staggered to the wall, are arranged in parallel. As a result, the feeding of sheet 6 can be performed more tightly and thus the entire dryer can be of smaller dimensions.

Commercial stretcher-rollers are suitable, for example, those described in German Published Patent Application Nos. 2,048,762 and 2,049,817.

Solvent-containing sheets, other than cast sheets can also be dried with the device and process of the invention. Examples of such other solvent-containing sheets are laminated sheets, printed sheets, coated sheets, etc.

What is claimed is:

1. Device for the drying of a plastic sheet or film containing solvent and/or moisture, consisting of a drying oven housing containing a single oven, having several stretcher-rollers in parallel relationship on the outside of two diametric side walls of the drying oven housing opposite one another, having sealable slots in the two diametric side walls, the sheet passing through the sealable slots and around the stretcher-rollers, two of the sealable slots being positioned in the two diamatric side walls for the feeding and removal of the sheet, and the remainder of the sealable slots being aligned in the two diametric side walls of the oven with the stretcher-rollers for the exit from and entance into the oven of the sheet in each instance of the sheet passing around one of the stretcher-rollers, and having openings for the introduction and removal of a heated dryer gas, only a single stretcher-roller being used for each turn of the sheet through the oven to reverse the direction of the sheet.

2. Device according to claim 1 wherein the stretcher-rollers, which are in parallel relationship, are staggered in relation to the wall of the dryer.

3. Process for the drying of a solvent-containing plastic sheet or film comprising deflecting the sheet to be dried by several stretcher-rollers only located outside of a drying oven containing a single oven and pulling the sheet through the drying oven free of contact.

4. Device for the drying of a plastic sheet or film containing solvent and/or moisture, consisting essentially of a drying oven housing containing a single oven, having several stretcher-rollers in parallel relationship on the outside of two diametric side walls of the drying oven housing opposite one another, having sealable slots in the two diametric side walls, the sheet passing through the sealable slots and around the stretcher-rollers, two of the sealable slots being positioned in the two diametric side walls for the feeding and removal of the sheet, and the remainder of the sealable slots being aligned in the two diametric side walls of the oven with the stretcher-rollers for the exit from and entrance into the oven of the sheet in each instance of the sheet passing around one of the stretcher-rollers, and having openings for the introduction and removal of a heated dryer gas, only a single stretcher-roller being used for each turn of the sheet through the oven to reverse the direction of the sheet, no operable stretcher-roller being located within said drying oven housing.

5. Device according to claim 4 wherein there is also at least one deflecting roller located near the feed path of said plastic sheet or film and proximate to one of said stretch-rollers, at least one deflecting roller located near the exit path of said plastic sheet or film and proximate to one of said stretch-rollers, and at least one pair of pulling rollers located proximate to the latter deflecting roller.

6. Device according to claim 4 wherein the stretcher-rollers, which are in parallel relationship, are staggered in relation to the wall of the dryer.

* * * * *